US007169292B2

(12) United States Patent
Chae et al.

(10) Patent No.: US 7,169,292 B2
(45) Date of Patent: Jan. 30, 2007

(54) PYROLYSIS TUBE AND PYROLYSIS METHOD FOR USING THE SAME

(75) Inventors: Jong-Hyun Chae, Taejeon (KR); Won-Ho Lee, Taejeon (KR); Sang-Mun Jeong, Taejeon (KR); Keun-Hoo Park, Yeosu (KR)

(73) Assignee: LG Chem, Ltd., Seoul (KR)

( * ) Notice: Subject to any disclaimer, the term of this patent is extended or adjusted under 35 U.S.C. 154(b) by 465 days.

(21) Appl. No.: 10/275,001

(22) PCT Filed: Mar. 6, 2002

(86) PCT No.: PCT/KR02/00387

§ 371 (c)(1),
(2), (4) Date: Oct. 31, 2002

(87) PCT Pub. No.: WO02/070626

PCT Pub. Date: Sep. 12, 2002

(65) Prior Publication Data

US 2003/0127361 A1 Jul. 10, 2003

(30) Foreign Application Priority Data

Mar. 7, 2001 (KR) ..... 10-2001-0011807

(51) Int. Cl.
*C10G 9/36* (2006.01)
*B01F 3/00* (2006.01)
*B01F 7/00* (2006.01)

(52) U.S. Cl. ..... 208/130; 208/106; 208/132; 138/37; 138/38; 165/177; 422/198; 422/224; 422/225; 422/229; 585/648; 585/921; 585/922

(58) Field of Classification Search ..... 208/132, 208/106, 130; 138/37, 38; 585/648, 921, 585/922; 165/177; 422/198, 224, 225, 229
See application file for complete search history.

(56) References Cited

U.S. PATENT DOCUMENTS

| | | | | |
|---|---|---|---|---|
| 4,466,741 | A * | 8/1984 | Kojima | 366/339 |
| 6,190,533 | B1 * | 2/2001 | Bradow et al. | 208/57 |
| 6,228,253 | B1 * | 5/2001 | Gandman | 208/48 AA |
| 6,380,449 | B1 * | 4/2002 | Butler et al. | 585/440 |
| 6,481,492 | B1 * | 11/2002 | Zhu et al. | 165/109.1 |
| 6,530,422 | B2 * | 3/2003 | Zhu et al. | 165/109.1 |

FOREIGN PATENT DOCUMENTS

| | | |
|---|---|---|
| DE | 1901758 A1 | 8/1970 |
| DE | 2405606 A1 | 8/1975 |
| JP | 53-46803 | 12/1978 |
| JP | 58-104991 A | 6/1983 |
| JP | 60-179495 | 9/1985 |
| JP | 01-200102 A | 8/1989 |
| JP | 09-292191 A | 11/1997 |

* cited by examiner

*Primary Examiner*—Glenn Caldarola
*Assistant Examiner*—Prem C. Singh
(74) *Attorney, Agent, or Firm*—Birch, Stewart, Kolasch & Birch, LLP

(57) ABSTRACT

The present invention provides a pyrolysis tube for enhancing the yield of olefins and reducing a coking tendency in steam cracking of hydrocarbons. According to the present invention, the pyrolysis tube is characterized in that a plurality of mixing blades made by twisting two ends of a plate in opposite directions are included therein. The yield of ethylene is thereby improved and the coking tendency is reduced by mixing a fluid flow, improving a heat transfer rate and shortening a residence time of the reactants therein.

7 Claims, 2 Drawing Sheets

PYROLYSIS TUBE AND PYROLYSIS METHOD FOR USING THE SAME

This application is the national phase under 35 U.S.C. §371 of PCT International Application No. PCT/KR02/00387 which has an International filing date of Mar. 6, 2002, which designated the United States of America.

BACKGROUND OF THE INVENTION

1. Field of the Invention

The present invention relates to pyrolysis of hydrocarbons, and especially to a pyrolysis tube for enhancing the yield of olefins and a pyrolysis method thereof.

2. Description of the Related Art

Steam cracking of hydrocarbons is a reaction to produce olefins such as ethylene and propylene by using naphtha, diesel and the like as a resource. The main ingredients of the naphtha, diesel and the like are paraffin-based hydrocarbons.

The following conventional process is provided for steam cracking of hydrocarbons. The hydrocarbons and water are respectively vaporized, mixed together, and then the mixture thereof is preheated to about 600° C. In the next step, the mixture is decomposed thermally while being passed through a hot pyrolysis tube at a temperature above 800° C.

Since pyrolysis is an endothermic reaction, heat must be continually supplied from the outside to maintain a reaction. Therefore, the pyrolysis tube is heated by radiant heat transferred from a burner to continually feed heat. The mixture is passed through the heated pyrolysis tube at a high velocity of 100~200 m/s and it resides therein for 0.2 to 0.4 seconds.

To improve a yield of olefin during pyrolysis, it is necessary to heat the mixture being passed through the pyrolysis tube quickly and uniformly, thereby preventing an undercracking and/or overcracking.

Since pyrolysis is an endothermic reaction as explained above, if the temperature gradient along the radius is high, hydrocarbons are thermally overcracked at the wall of the pyrolysis tube while it is thermally undercracked at the center of the pyrolysis tube, thereby yielding less olefin.

Moreover, the longer the residence time of the mixture in the pyrolysis tube, the more intensively secondary reactions of the olefins take place. The details of the secondary reactions of the olefins are as follows:

1) olefins are converted into aromatics by combining with each other;

2) olefins are converted into acetylene or diolefin by dehydrogenation; and 3) olefins are converted into methane by decomposition.

The secondary reactions of the olefin not only decrease the yield of the olefin, but they also increase a coking tendency in the pyrolysis tube, thereby lowering a heat transfer rate and shortening the longevity of the pyrolysis tube.

Therefore, since there should be a reduction in the residence time of the mixture in the pyrolysis tube, it is necessary to increase a fluid flow velocity or to use a pyrolysis tube of a small effective diameter.

In the former method of increasing the fluid flow velocity, if the residence time of the mixture in the pyrolysis tube is too short, the mixture cannot be provided with sufficient heat to react, and therefore some hydrocarbons are undercracked. As a result, there is a decrease in yield of olefin. Therefore, when pyrolysis tubes of the same effective diameter are used, a suitable residence time is necessary to maximize the yield of the olefin.

In the latter method of using a pyrolysis tube of a small effective diameter, since the temperature of the outer wall of the pyrolysis tube can be decreased because of relatively effective heat transfer, there is an advantage of reducing the coking tendency on the inner wall of the pyrolysis tube. However, since the diameter of the pyrolysis tube is small, depending on operating conditions, the cross-sectional area of the tube can be diminished more quickly by the coke, thereby necessitating frequent decoking of the tube. When the effective diameter of the pyrolysis tube is too small, or if the cross-sectional area of the tube is lessened because of the influence of the coke, there is an increase in pressure drop, thereby decreasing the yield of olefin with respect to the reaction mechanism.

Therefore, among the methods for manufacturing olefins by thermally cracking hydrocarbons, methods for increasing the yield of olefin with less coking tendency are provided.

U.S. Pat. No. 4,342,642 describes a method of producing a desired increase in heat flux without adversely increasing pressure drop. The method is accomplished by using a tube insert spaced away from the inner tube wall having outwardly extending arms or vanes that touch or almost touch the inner wall of the tube, and such a configuration has been found to provide a heat absorption surface that produces a desired increase in heat flux. The insert sub-divides a free internal cross-section of the tube into equal areas.

In the above invention, since the fluid in each sub-divided equal area cannot be mixed together, there is a limit as to uniformity of heating the mixture. In addition, since the coking area in the pyrolysis tube with the insert is larger than the area without an insert, the pressure drop caused by the coke adversely increases. Therefore, there is a problem in that the coke must be removed frequently.

French Patent No. 2,688,797 describes a method of heating the mixture uniformly in the pyrolysis tube. The method is accomplished by an insert with a long surface being installed along the axial direction in the rear end of the pyrolysis tube to improve the heat transfer rate and to develop turbulence.

Japanese laid-open Patent No. 9,292,191 provides a method of disposing a bar having fixed pins along the axial direction, thereby mixing the fluids passing through the pyrolysis tube.

The above French Patent and Japanese laid-open Patent have a common feature of using turbulence generated by pins or an insert within the pyrolysis tube. On the other hand, in both patents, assuming that the same quantity of mixture is passed through the pyrolysis tube with the insert as without, since the cross-sectional area of the pyrolysis tube decreases, there is a problem in that the velocity of the fluid flow in the pyrolysis tube increases. This also causes an increase of pressure drop in the pyrolysis tube.

In addition, Japanese laid-open Patent No. 11,199,876 describes a method of making protrusions in a pyrolysis tube. According to the above Japanese laid-open Patent, the fluid flow passing through the pyrolysis tube collides with the tube wall due to the protrusions, thereby preventing the fluid flow adjacent to the tube wall from stagnating and overheating. Therefore, it is possible to decrease the yield of coke.

According to the above specification, by mixing the fluid to the utmost, there is a decrease in coking of the tube and it is not necessary to remove the coke so frequently. However, it is described that there is little increase in the yield of ethylene.

In the conventional methods described above, heat transfer to the fluid passing through the pyrolysis tube is increased by reducing the effective diameter of the pyrolysis tube or increasing its effective surface area. Alternatively, the heat transfer rate is increased or the mixture is mixed uniformly by generating turbulence or swirl in the fluid flow passing through the pyrolysis tube due to pins or protrusions. Therefore, the method decreases the coking tendency.

However, the above methods have problems in that there is an increase in pressure drop or there is little improvement in yield of ethylene.

SUMMARY OF THE INVENTION

It is therefore an object of the present invention to provide a pyrolysis tube to procure more ethylene and less coke, as well as to not adversely increase pressure drop, and a pyrolysis method thereof.

In the present invention, pyrolysis takes place when hydrocarbons and steam are mixed together and passed through the pyrolysis tube.

The pyrolysis tube of the present invention comprises mixing blades, which are made by twisting two ends of a plate in opposite directions, and which are installed in an axial direction in the pyrolysis tube. The mixing blades are preferably made by twisting the plates 180 degrees.

In the pyrolysis tube, at least two mixing blades are installed, disposed to make ends of a first mixing blade intersect ends of a second mixing blade, preferably at a right angle. The pyrolysis tube can comprise a potassium-based compound coated on the surface of the mixing blades or on its inner surface, and entire volume of the mixing blades can be varied from 1% to 20% of the inner volume of the pyrolysis tube.

The pyrolysis takes place according to the following steps. Hydrocarbons and water are respectively inflowed into a vaporizer for vaporizing, and they are forwarded to a preheater using one channel for mixing, and then the mixture thereof is preheated. Next, the mixture is passed through the pyrolysis tube and is thermally decomposed. Finally, the decomposed products exiting the pyrolysis tube are condensed.

In the above step, the pyrolysis tube includes a plurality of mixing blades made by twisting two ends of a plate in opposite directions. Moreover, the pyrolysis tube is heated to between 600° C. and 1000° C., the ratio of steam/hydrocarbon is from 0.3 to 3.0 by weight, and liquid hourly space velocity (referred to as an "LHSV" hereinafter) is from 1 $hr^{-1}$ to 20 $hr^{-1}$.

DETAILED DESCRIPTION OF THE PREFERRED EMBODIMENTS

The present invention now will be described more fully hereinafter with reference to the accompanying drawings, in which preferred embodiments of the inventions are shown. This invention may, however, be embodied in many different forms and should not be construed as limited to the embodiments set forth herein.

Figure 1:
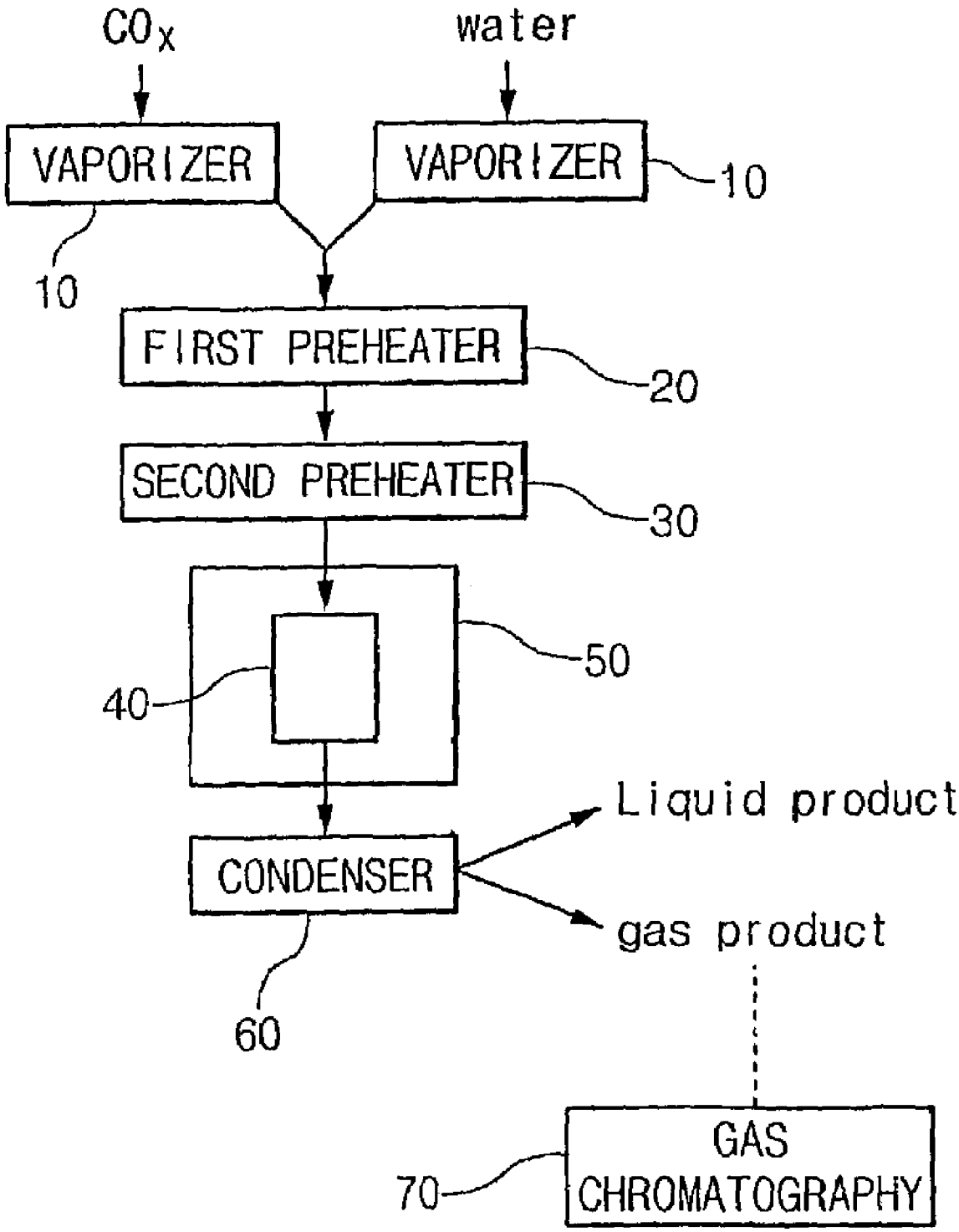
FIG. 1 is a block diagram to explain pyrolysis of the first embodiment using a pyrolysis tube according to the present invention.

FIG. 1 shows a block diagram to explain pyrolysis using a pyrolysis tube of the present invention. A pyrolysis apparatus consists of a plurality of units shown in FIG. 1. As shown in the pyrolysis apparatus of FIG. 1, inflowed hydrocarbons and water are respectively passed through a vaporizer 10, and they are then mixed together. Next, the mixture is passed through a first preheater 20 at 550° C. and a second preheater 30 at 650° C. Then it is inflowed to a pyrolysis tube 40.

The mixture is passed through the pyrolysis tube 40 and is thermally decomposed. The pyrolysis tube 40 is heated to 880° C. in an electric furnace 50 that is divided into three zones.

The mixture passed through the pyrolysis tube 40 is condensed into water and heavy oil, and it is then separated into a liquid mixture while being passed through a condenser 60. A residual gaseous mixture is analyzed by on-line gas chromatography 70, and is then discharged.

Figure 2:
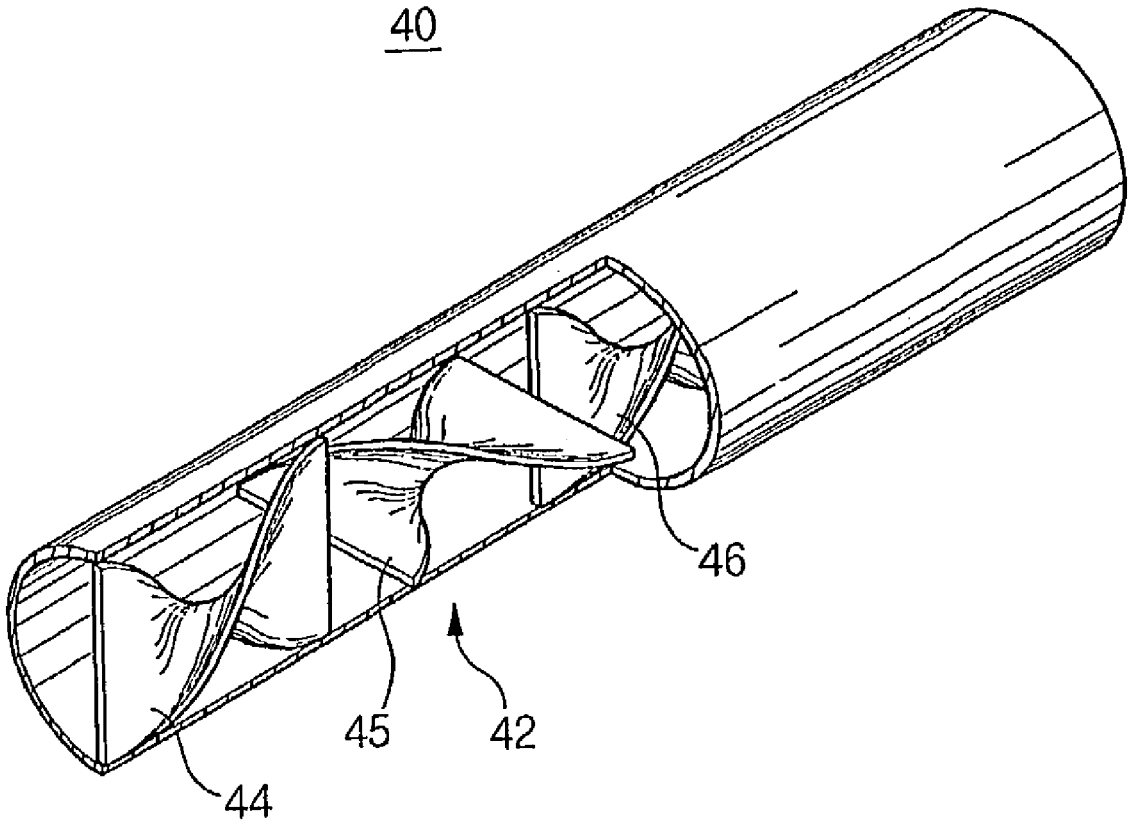
FIG. 2 is an internal perspective view of a pyrolysis tube according to the present invention.

As shown in FIG. 2, a mixer 42 is fixed in the pyrolysis tube 40 in which pyrolysis takes place, according to the pyrolysis process of the present invention.

The mixer 42 is an assembly of a plurality of mixing blades 44, 45, 46 and the like, and they are connected to each other along the axial direction.

The mixing blades 44, 45 and 46 are made by twisting a plate at 180 degrees, a width of which corresponds to the inside diameter of the tube, and the ends of each mixing blade intersect those of the adjacent mixing blade, preferably at right angles. Additionally, adjacent blades are twisted in opposite directions.

The outer edges of the mixing blades 44, 45 and 46 are welded to inner parts of the pyrolysis tube 40 to fix the mixing blades 44, 45 and 46 in the pyrolysis tube 40. Conventional welding methods such as spot welding, laser welding, electric welding and the like can be used.

The volume of the mixer 42 inserted in the pyrolysis tube 40 is preferably manufactured to be within 1% to 20% of the inner volume of the pyrolysis tube, and is more preferably manufactured to be less than 10% of the inner volume of the pyrolysis tube. Therefore, since the fluid flow velocity of the mixture is not increased greatly, it is possible to prevent the excessive pressure drop.

Preferably, the reaction temperature in the pyrolysis tube 40 is 600° C. to 1000° C., the ratio of steam to hydrocarbon is 0.3 to 3.0, and LHSV is 1 $hr^{-1}$ to 20$hr^{-1}$.

The fluid flow in the pyrolysis tube will be described more fully hereinafter, while referring to the accompanying drawings.

First, the fluid flow is separated into two areas while passing through the first mixing blade 44, and each separated flow is divided again into two halves while passing through the second mixing blade 45 which is cross-connected to the first mixing blade 44 at a right angle.

While the fluid flow continually passes through the mixing blades 44, 45 and 46 cross-connected at right angles, the fluid flow is divided in geometric progression: for example, if there are two mixing blades, the fluid flow is divided by the order of two.

In addition, though the fluid flow is divided continually while passing through the mixing blades, the divided flow is assembled again. This process is continually repeated.

In the pyrolysis tube 40 in which the mixing blades 44, 45 and 46 are fixed, since the fluid flow causes mixing in the radial direction, for example, it flows from the center of the pyrolysis tube to an inner surface thereof and vice versa, heat transfer from the heated surface of the pyrolysis tube to the fluid flow is improved.

Since the pyrolysis tube 40, in which the mixer 42 is fixed, continually separates, assembles, and causes the fluid flow to mix in the radial direction, the fluid flow can be heated quickly and uniformly.

As a result, the temperature gradient of the pyrolysis tube in the radial direction, which may occur as a result of the endothermic reaction (pyrolysis), can be minimized.

In addition, the swirl flow taking place because of the mixing blades 44, 45 and 46 reduces the coking tendency in the pyrolysis tube.

Therefore, the pyrolysis tube 40 including the mixer 42 can mix the fluid flow using the mixer 42, increase the heat transfer rate and shorten a residence time of the reaction mixture, thereby increasing the yield of ethylene and reducing the coking tendency.

Moreover, the inner surface of the pyrolysis tube 40 in which the mixer 42 is fixed, or the surface of the mixing blades 44, 45 and 46, is coated with $B_2O_3$, or a potassium-based compound such as $KVO_3$, thereby eliminating the coke that is not removed physically, from the pyrolysis tube. The $B_2O_3$, is a compound to restrain coke generation, and the $KVO_3$ is an active material to transform the coke into $CO_x$ gas.

Now, the effect of the present invention will be described hereinafter according to the embodiments. The process of the first to third embodiments progresses as the above explanation referring to FIG. 1.

Embodiment I

In the first embodiment, everything of the pyrolysis apparatus is the same but the quantity of condenser 60. A couple of condensers are connected to each other in series.

The pyrolysis is carried out by using the pyrolysis tube 40. With respect to the pyrolysis tube 40 including the mixer 42, its outside diameter and length are ⅜ inch and 60 cm, respectively.

According to the first embodiment, naphtha is used as a hydrocarbon, and its composition and properties are described in a table I.

TABLE I

| | |
|---|---|
| specific gravity (g/cc) | 0.675 |
| initial boiling point (° C.) | 30.9 |
| final boiling point (° C.) | 160.7 |
| n-parafin (wt %) | 39.5 |
| l-parafin (wt %) | 38.9 |
| naphthene (wt %) | 15.3 |
| aromatic (wt %) | 6.3 |

The naphtha and water are inflowed into the pyrolysis apparatus. The naphtha is controlled to be twice as much as the water by weight, and the flow of naphtha is controlled to be 10 in LHSV.

The yield of the ethylene is calculated in accordance with the following equation I in the present invention, and that of other products is calculated in the same manner.

Equation I $$\text{yield of ethylene (\%)} = \text{amount of ethylene product} / \text{amount of naphtha feed} \times 100$$

As shown in a table II, "A" represents the yield of the main products when using the pyrolysis tube in which the mixer is fixed, and "B" represents the yield of the main products when using the pyrolysis tube without the mixer. The outer diameter and length of each pyrolysis tube are ⅜ inch and 60 cm, respectively.

TABLE II

| | | A | B |
|---|---|---|---|
| inflowing amount of the reactant | naphtha (cc/min) | 4.53 | 4.53 |
| | water (cc/min) | 1.53 | 1.53 |
| | water/naphtha in weight | 0.5 | 0.5 |
| | LHSV, $hr^{-1}$ (naphtha basis) | 10 | 10 |
| | reaction temp (° C.) | 880 | 880 |
| yield of the product (wt %) | $H_2$ | 1.03 | 0.78 |
| | CO | 0.34 | 0.07 |
| | $CO_2$ | 0.01 | 0.00 |
| | $CH_4$ | 14.9 | 10.9 |
| | $C_2H_4$ | 35.6 | 29.2 |
| | $C_3H_6$ | 13.7 | 14.4 |
| | $C_2H_4 + C_3H_6$ | 49.3 | 43.6 |

Embodiment II

The reaction conditions and experimental methods of the second embodiment are the same as those of the first embodiment, except the LHSV is 18. A table III shows the results of a pyrolysis experiment when the LHSV of naphtha is 18.

TABLE III

| | | A | B |
|---|---|---|---|
| inflowing amount of the reactant | naphtha (cc/min) | 8.17 | 8.17 |
| | water (cc/min) | 2.76 | 2.76 |
| | water/naphtha in weight | 0.5 | 0.5 |
| | LHSV, $hr^{-1}$ (naphtha basis) | 18 | 18 |
| | reaction temp (° C.) | 880 | 880 |
| yield of the product (wt %) | $H_2$ | 0.72 | 0.59 |
| | CO | 0.04 | 0.02 |
| | $CO_2$ | 0.00 | 0.00 |
| | $CH_4$ | 10.7 | 7.8 |
| | $C_2H_4$ | 27.0 | 21.7 |
| | $C_3H_6$ | 16.6 | 14.8 |
| | $C_2H_4 + C_3H_6$ | 43.6 | 36.5 |

Embodiment III

The reaction conditions and experimental methods of the third embodiment are the same as those of the second embodiment, except that the outer diameter of the pyrolysis tube is ½ inch. A table IV shows the results of the pyrolysis experiment.

TABLE IV

| | | A | B |
|---|---|---|---|
| inflowing amount of the reactant | naphtha (cc/min) | 8.17 | 8.17 |
| | water (cc/min) | 2.76 | 2.76 |
| | water/naphtha in weight | 0.5 | 0.5 |
| | LHSV, $hr^{-1}$ (naphtha basis) | 10 | 10 |
| | reaction temp (° C.) | 880 | 880 |
| yield of the product (wt %) | $H_2$ | 1.01 | 0.64 |
| | CO | 0.25 | 0.05 |
| | $CO_2$ | 0.03 | 0.00 |
| | $CH_4$ | 14.9 | 9.2 |
| | $C_2H_4$ | 34.4 | 23.9 |
| | $C_3H_6$ | 15.3 | 12.8 |
| | $C_2H_4 + C_3H_6$ | 49.7 | 36.7 |

The effect of using the pyrolysis tube including the mixer will be explained hereinafter.

As a result of mixing by the mixer in the pyrolysis tube, thermal transfer from the pyrolysis tube to the fluid flow is improved, the fluid flow is heated and mixed uniformly, and the stagnant flow of the fluid near the inner surface of the pyrolysis tube is removed, thereby preventing the hydrocarbons from over-cracking or undercracking.

Moreover, since the mixer not only provides an operation to mix the fluid flow but also provides its own surface to absorb radiant heat of the pyrolysis tube, an effective surface area of the pyrolysis tube including the mixer is enlarged, thereby improving the heat transfer rate and increasing the yield of olefin. In addition, a swirling flow of the fluid takes place because of the mixer in the pyrolysis tube, thereby reducing the coking tendency in the pyrolysis tube.

As the area occupied by the mixer fixed in the pyrolysis tube is very small, a cross-sectional area of the pyrolysis tube through which the fluid passes is slightly decreased and the increase in linear velocity caused by the area is small. Therefore, the pressure drop is not significant.

Moreover, if the surfaces of the pyrolysis tube and the mixer are coated with a material for restraining generation of coke or an active material for converting the generated coke into $CO_x$, the coking tendency can be reduced more significantly on the inner surface of the pyrolysis tube and/or the mixer.

What is claimed is:

1. A pyrolysis tube comprising mixing blades, wherein pyrolysis takes place when hydrocarbons and vapor are mixed together and passed through the pyrolysis tube, wherein at least a first and a second mixing blade, made by twisting two ends of a plate 180 degrees in opposite directions, are installed in an axial direction in the pyrolysis tube, and wherein the mixing blades are disposed to make ends of the first mixing blade intersect ends of the second mixing blade at a right angle.

2. The pyrolysis tube of claim 1, wherein the pyrolysis tube comprises a potassium based compound coated on a surface of the mixing blades or on an inner surface of the pyrolysis tube.

3. The pyrolysis tube of claim 1, wherein an entire volume of the mixing blades is from 1% to 20% of an inner volume of the pyrolysis tube.

4. The pyrolysis tube of claim 2, wherein an entire volume of the mixing blades is from 1% to 20% of an inner volume of the pyrolysis tube.

5. A pyrolysis method comprising the steps of:

inflowing hydrocarbons and water into a vaporizer for respectively vaporizing them, and forwarding the vaporized gases to a preheater using one channel for mixing;

preheating the mixture exiting the vaporizer;

passing the mixture through a pyrolysis tube and thermally decomposing the mixture; and condensing the decomposed mixture exiting the pyrolysis tube, wherein the pyrolysis tube includes a plurality of mixing blades, said mixing blades made by twisting two ends of a plate 180 degrees in opposite directions, said mixing blades being installed in an axial direction in the pyrolysis tube, and the mixing blades being disposed to make ends of a first mixing blade intersect ends of a second mixing blade at a right angle, and wherein said pyrolysis tube is heated to between 600° C. and 1000° C., a ratio of water/hydrocarbon is from 0.3 to 3.0 by weight, and an LHSV is from 1 $hr^{-1}$ to 20 $hr^{-1}$.

6. The pyrolysis tube of claim 1, wherein an entire volume of the mixing blades is less than 10% of an inner volume of the pyrolysis tube.

7. The pyrolysis tube of claim 1, wherein fluid flow through the pyrolysis tube is separated into two half areas while passing the first mixing blade, and each separated flow is divided again into two half areas while passing through the second mixing blade.

* * * * *